United States Patent [19]

Reinke

[11] Patent Number: 4,955,620

[45] Date of Patent: Sep. 11, 1990

[54] AERIAL GAME PROJECTILE

[76] Inventor: Thomas E. Reinke, 3975 North 71st St., Milwaukee, Wis. 53216

[21] Appl. No.: 384,506

[22] Filed: Jul. 24, 1989

[51] Int. Cl.[5] ..... A63B 65/00

[52] U.S. Cl. ..... 273/428; 273/26 R

[58] Field of Search ..... 273/428, 65 E G, 60 B, 273/128 A, 28, 26 R

[56] References Cited

U.S. PATENT DOCUMENTS

| | | | |
|---|---|---|---|
| D. 33,270 | 9/1900 | Avery | 273/428 X |
| 2,683,603 | 7/1954 | Gackenbach | 273/428 |
| 2,982,550 | 5/1961 | Francis | 273/428 |
| 3,761,087 | 9/1973 | Meyer | 273/128 A X |
| 3,884,466 | 5/1975 | MacDonald et al. | 273/65 EG X |
| 4,772,020 | 9/1988 | Martin | 273/65 EG X |

*Primary Examiner*—Paul E. Shapiro

*Attorney, Agent, or Firm*—Foley & Lardner

[57] ABSTRACT

An aerial game projectile useful in batting and throwing games is defined by a generally frustro conical body having closed ends and a side wall formed externally with a series of flights which extend generally longitudinally of the projectile on a portion thereof. The projectile is constructed and arranged to be thrown or launched in motion transverse to its longitudinal axis to simulate the curved flight of a ball.

8 Claims, 2 Drawing Sheets

AERIAL GAME PROJECTILE

TECHNICAL FIELD

The present invention relates generally to toys or recreational devices which exhibit various aerodynamic flight patterns when hurled or launched in the air and, more particularly, to a projectile which may be employed in various batting and throwing games.

BACKGROUND OF INVENTION

In playing baseball, it is well known that players are constantly striving to define their pitching and hitting skills. On the one hand, a pitcher seeks to control the flight of a ball by developing proper wrist action while, on the other, a batter attempts to hit the hurled projectile regardless of which path it takes. Through continuous practice and exposure to curved projectiles, a hitter can build concentration and improve hand/eye coordination in order to improve hitting consistently.

Over the years, a myriad of aerial projectiles intended to provide somewhat predictable flight paths have been developed for various amusement purposes. Many of these devices are hollow, generally cylindrical in shape and are dependent upon entry of air into their interior during flight to impart the desired motion. Examples of such recent devices are shown in U.S. Pat. Nos. 4,151,674 issued to Klahn et al. on May 1, 1979, 4,246,721 issued to Bowers on Jan. 27, 1981, and 4,390,148 issued to Cudmore on June 28, 1983. All of these devices are basically intended to be thrown and caught but have not been designed with the intent of providing a ball-like substitute which may be used as a training tool to hone batting skills.

If one further considers the age old game of stickball wherein hitting a small ball-like object has been acknowledged in some circles to be a positive training technique useful in modern baseball, it can be appreciated that a relatively small or compact, durable projectile which also simulates the curved behavior of a regular baseball would be a desirable training implement.

One construction which embodies these general characteristics is disclosed in U.S. Pat. No. 2,683,603 issued to Gackenbach on July 13, 1954. In this projectile, a generally hollow, cylindrical member is provided with a series of helical grooves in order to simulate baseball curves While this design provides certain desirable flight performance, it must depend upon a peculiar warping of its axis, an eccentric weighting, and the combined airflow on both the inside and outside cylindrical surfaces From the foregoing, it can be seen that various attempts have been made by the prior art to provide aerial projectiles capable of varying aerodynamic behavior. However, most of the recent innovations by sporting goods manufacturers and distributors have appeared to overlook the need for an aerial projectile which may be more easily thrown than a regular baseball and utilized to improve batting proficiency.

SUMMARY OF THE INVENTION

The present invention advantageously provides an improved aerial projectile useful in batting and throwing games The improved aerial projectile offers versatility, reasonable cost, simplicity of construction, and contemplates an enhanced safety factor due to its shape and material.

These and other advantages are realized in one aspect of the invention by an aerial game projectile comprising a generally frustro conical body having closed ends and a side wall which is formed externally with a plurality of flights which extend generally longitudinally of the projectile on a portion thereof. The side wall defines a head portion and a base portion, the latter having a larger diameter.

In a highly preferred embodiment, the aerial projectile has a solid, generally frustro conical body of a lightweight resilient body having substantially flat, closed ends and includes a side wall defining a base portion having a larger diameter than a head portion. Grooves are formed extending generally longitudinally of the projectile on the base portion. The projectile is constructed and arranged to be thrown or launched in motion transverse to its longitudinal axis to simulate the curved flight of a ball.

BRIEF DESCRIPTION OF THE DRAWING

The invention will become better understood by reference to the following detailed description of the preferred exemplary embodiment when read in conjunction with the appended drawing wherein like numerals denote like elements and.

DETAILED DESCRIPTION OF THE PREFERRED EMBODIMENTS

Figure 1:
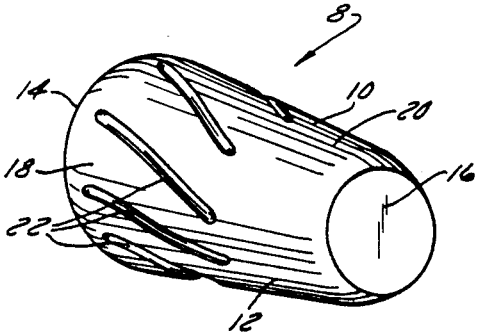
FIG. 1 is a view in perspective of an aerial game projectile employing the present invention.

Referring to FIG. 1, the novel aerial projectile 8 has a generally frustro conical, solid body 10 of symmetrical configuration. Body 10 includes a continuous, smooth side wall 12 and substantially flat, closed ends 14, 16. Side wall 12 defines a base portion 18 and a head portion 20 having a smaller diameter than base portion 18. Side wall 12 is formed with a series of angled flights or grooves 22 which extend generally longitudinally on base portion 18.

Projectile 8 is preferably constructed of a light weight, durable material such as cork or rubber foam which would not harm a player hit by the projectile. However, projectile 8 may be made of various suitable equivalent materials such as from plastics which exhibit similar characteristics. In addition, projectile 8 may be configured in various sizes and shapes as well as densities depending on use. For instance, larger versions of projectile 8 would be utilized for general recreational purposes such as parties, picnics and the like as contrasted with smaller models as used for competitive or training purposes. Additionally, if projectile 8 is used outdoors rather than indoors, since the wind becomes an important factor, a greater size, density or weight should be used. Although not limited to these dimensions, a typical projectile 8 may be 1¼" in length with a diameter of 1⅛" for base portion 18 and a diameter of ⅞" for head portion 20. Side wall 12 is typically formed with eight grooves 22 spaced equidistantly. In FIG. 1, the angle of grooves 22 lies approximately 35° with respect to end 14.

Figure 2:
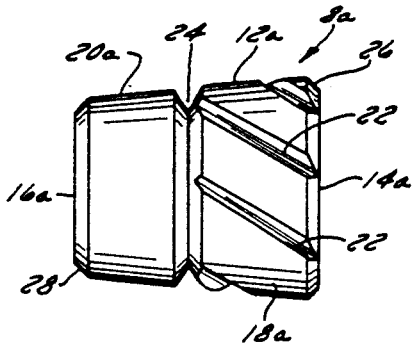
FIG. 2 is a side view of a first alternative embodiment of the invention.
Figure 3:
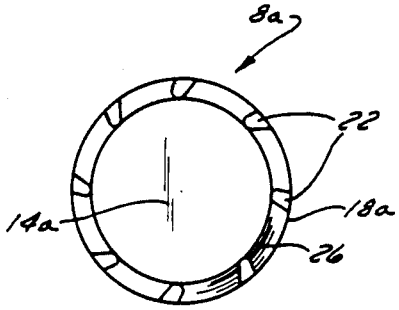
FIG. 3 is a cross sectional view of FIG. 2.
Figure 4:
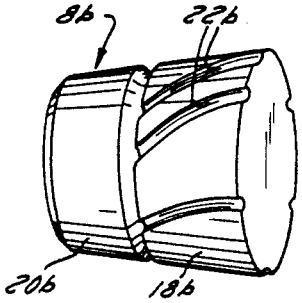
FIG. 4 is a perspective view of a second alternative embodiment of the invention.
Figure 5:
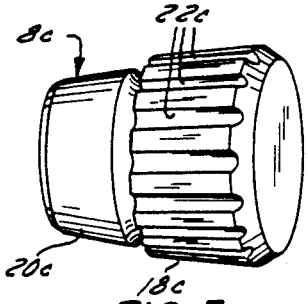
FIG. 5 is a perspective view of a third alternative embodiment of the invention.
Figure 6:
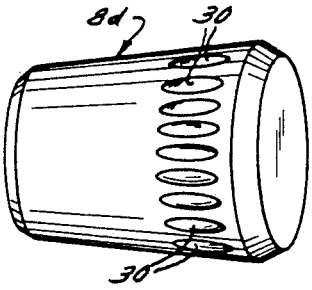
FIG. 6 is a perspective view of a fourth alternative embodiment of the invention.
Figure 7:
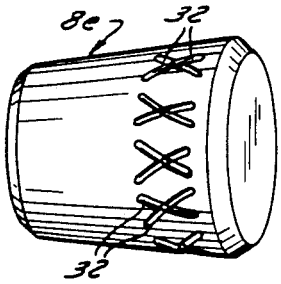
FIG. 7 is a perspective view of a fifth alternative embodiment of the invention.

FIGS. 2 and 3 illustrate a first alternative embodiment wherein projectile 8*a* includes an annular groove 24 which communicates with grooves or flights 22*a* for a purpose to be appreciated hereafter In addition, bevelled edges 26, 28 are formed on projectile 8*a* preferably at an angle of 45° with respect to ends 14*a*, 16*a* in order to reduce wind resistance or drag when in flight. These bevelled edges 26, 28 may be on either end or both ends of projectile 8*a* as desired FIGS. 4, 5, 6 and 7 disclose further alternative embodiments of the invention which exhibit slightly varying flight performance. FIG. 4 shows helically shaped or spiral grooves 22*b*. FIG. 5 shows a higher number of more closely spaced grooves 22*c* on a larger base portion 18*c*. FIG. 6 embodies a series of flights in the form of dimples 30 while FIG. 7 discloses intersecting grooves 32 cut into projectile 8*e*.

Figure 8:
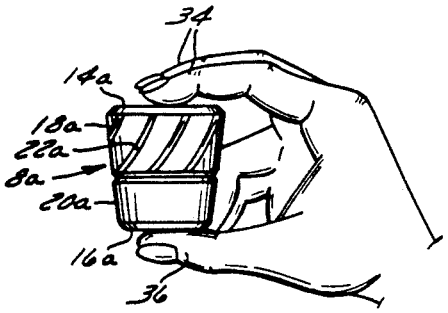
FIG. 8 is a view showing one method of gripping the projectile.

FIG. 8 shows one method of gripping the projectile 8*a* to throw it, wherein preferably a player's first two fingers 34 engage one of ends 14*a*, 16*a* while the player's thumb 36 holds the other of ends 14*a*, 16*a*. This grip imparts an end-over-end motion which translates to a straight pitch such as a fastball.

Figure 9:
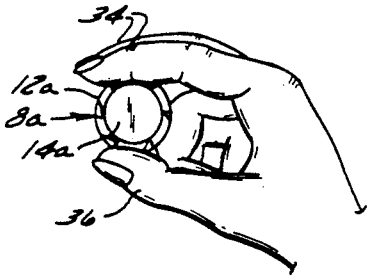
FIG. 9 is a view showing another method of throwing the projectile.
Figure 10:
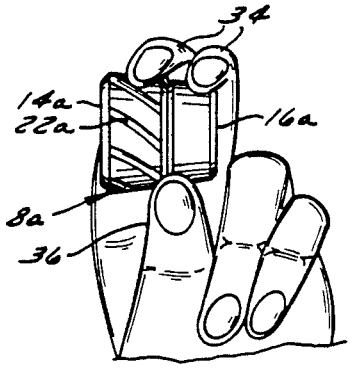
FIG. 10 is a view showing one position at FIG. 9.
Figure 11:
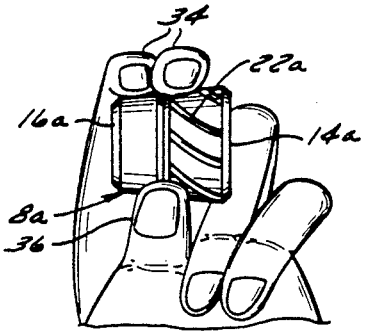
FIG. 11 is a view showing another position of FIG. 9.

FIG. 9 indicates a second method of hurling projectile 8*a* wherein a player's first two fingers 34 and thumb 36 are wrapped along side wall 12*a*. In one position, FIG. 10, the players first two fingers 34 are positioned on head portion 20*a* with grooves 22*a* oriented inwardly of the player. A straight overhead toss will then cause projectile 8*a* to simulate a baseball which will break to the left In another position, FIG. 11, with projectile 8*a* switched so that grooves 22*a* lie outwardly of the player, an overhead toss will cause projectile to curve right. The more back spin or follow through as well as velocity applied to the throw will increase the degree of curvature as long as there is no great variance in the wind resistance However, by virtue of the shape of projectile and the aerodynamic motion of the air in the grooves 22*a* and 24*a*, and along the external surface of side wall 12*a*, the projectile path conforms to a curve, screw or drop of a baseball without having to dramatically control the snap of one's wrist.

Unlike prior art devices, the present invention provides for simulated flight trajectory of a baseball without relying on the aerodynamic action of the air on an inner surface of a hollow device. The present invention does not require eccentric weighting or assymmetrical construction.

While the invention has been described as being manually thrown or hurled, it should be understood projectile 8 may be adapted to be launched such as by a pitching machine which could duplicate the gripping positions described above In addition, the projectile 8 may be tossed in games of catch like baseball or Frisbee. When used as a training and in hitting, projectile may be employed with any type of bat or stick construction and may be hit to another player with less chance of injury than a baseball due to its relatively lightweight material. Those skilled in the art will appreciate certain other substitutions, alterations and omissions may be made without departing from the spirit thereof. Accordingly, the foregoing description is meant to be exemplary only and should not be deemed limitative on the scope of invention set forth in the appended claims

I claim:

1. An aerial game projectile useful in batting and throwing games comprising a generally frustro conical body having closed ends and a side wall being formed externally with a plurality of flights extending generally longitudinally of the projectile on a portion thereof, said side wall defining a head portion and a base portion, said base portion having a diameter which is larger than said head portion, said flights being formed in said base portion only, and said side wall being provided with an annular groove separating said base portion from said head portion.

2. The aerial game projectile of claim 1, wherein said flights communicate with said annular groove.

3. The aerial game projectile of claim 2, wherein at least one of said base and head portions is bevelled.

4. The aerial game projectile of claim 1, wherein said flights are formed by dimples.

5. The aerial game projectile of claim 1, wherein said flights are formed by intersecting grooves.

6. The aerial game projectile of claim 1, wherein said flights are formed by grooves lying generally parallel to the longitudinal axes of said projectile.

7. The aerial game projectile of claim 1, wherein said flights are formed by helical grooves.

8. An aerial game projectile adapted to be thrown or launched comprising a solid, generally frustro conical body of lightweight, resilient material having substantially flat closed ends and a side wall defining a base portion and a head portion, said base portion having a diameter greater than said head portion, said body having an axial length greater than the diameter of either said head or base portions, said side wall being formed with a plurality of grooves extending longitudinally of the projectile on only said base portion thereof, and a singular annular groove separating said base portion from said head portion, said projectile constructed and arranged to be thrown or launched in a motion generally transverse to the longitudinal axis thereof to simulate curved flight of a ball.

* * * * *